United States Patent [19]

Herrell et al.

[11] Patent Number: 4,871,316

[45] Date of Patent: Oct. 3, 1989

[54] PRINTED WIRE CONNECTOR

[75] Inventors: Dennis J. Herrell, Austin, Tex.; Omkarnath R. Gupta, Englewood, Colo.

[73] Assignee: Microelectronics and Computer Technology Corporation, Austin, Tex.

[21] Appl. No.: 258,939

[22] Filed: Oct. 17, 1988

[51] Int. Cl.[4] ..... H01R 9/09

[52] U.S. Cl. ..... 439/66; 439/68; 439/91; 439/591; 439/74

[58] Field of Search ..... 439/66, 68, 69, 74, 439/91, 591

[56] References Cited

U.S. PATENT DOCUMENTS

| | | | |
|---|---|---|---|
| 2,396,725 | 3/1946 | Thomas, Jr. | 173/324 |
| 2,864,977 | 12/1958 | Witt et al. | 317/101 |
| 3,215,968 | 11/1965 | Herrmann | 339/17 |
| 3,226,669 | 12/1985 | Lutz | 339/198 |
| 3,235,942 | 2/1966 | Howell et al. | 29/155.5 |
| 3,430,182 | 2/1969 | Blanche | 339/17 |
| 3,601,762 | 8/1971 | Eshelman | 339/64 M |
| 3,601,772 | 8/1971 | Mancini | 339/156 R |
| 3,795,037 | 3/1974 | Luttmer | 439/591 |
| 3,852,878 | 12/1974 | Munro | 339/171 M |
| 3,954,317 | 5/1976 | Gillssen et al. | 339/17 M |
| 3,998,513 | 12/1976 | Kobayashi et al. | 339/59 M |
| 4,050,769 | 9/1977 | Ammon | 339/196 M |
| 4,199,209 | 4/1980 | Cherian et al. | 439/66 |
| 4,201,435 | 5/1980 | Nakamura et al. | 339/59 M |
| 4,295,700 | 10/1981 | Sado | 339/61 M |
| 4,402,562 | 9/1983 | Sado | 439/66 |
| 4,408,814 | 10/1983 | Takashi et al. | 339/59 M |
| 4,533,203 | 8/1985 | Feldman et al. | 339/176 M |
| 4,552,420 | 11/1985 | Elgenbrode | 339/14 R |
| 4,752,231 | 6/1988 | Olsson | 439/66 |
| 4,793,814 | 12/1988 | Zifcak et al. | 439/66 |
| 4,806,104 | 2/1989 | Cabourne | 439/66 |
| 4,820,170 | 4/1989 | Redmond et al. | 439/66 |

*Primary Examiner*—P. Austin Bradley

*Attorney, Agent, or Firm*—Fulbright & Jaworski

[57] ABSTRACT

A high density, high performance and high fidelity connector system that can connect between electronic circuit planes having different wiring densities. The connector has a modular structure that avoids tolerance build-up for large (long) connections between two substrates, or between a substrate and a board. The connector design can accommodate differential temperature coefficients of expansion between the connector materials and the materials of the substrates being connected. The connector can be formed from low cost printed circuit board technology, or its equivalent, and can be configured to have controlled impedance, low crosstalk and wide bandwidth. The angle between surfaces being interconnected can vary from 0 to 360 degrees.

19 Claims, 6 Drawing Sheets

Fig. 8
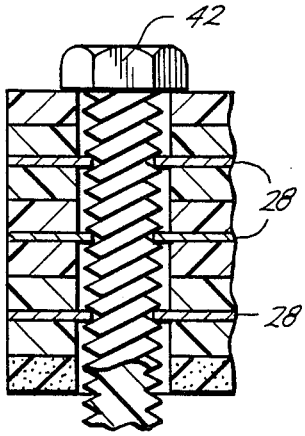
Fig. 9
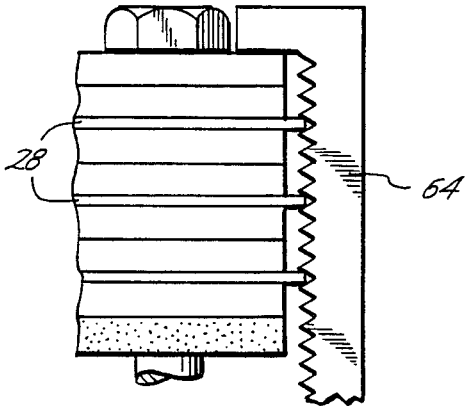
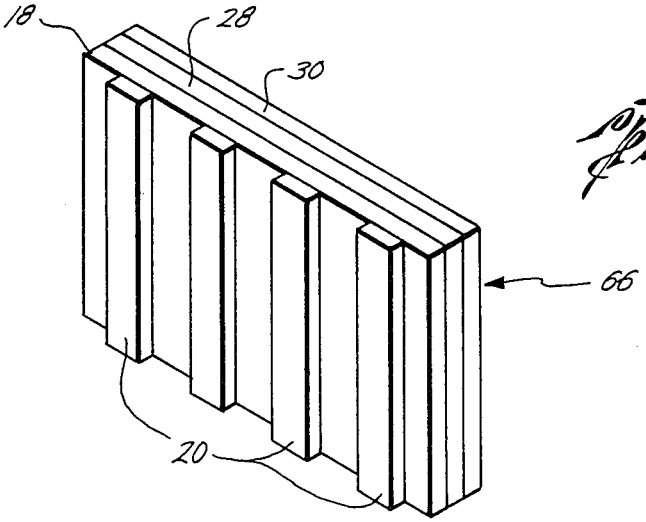
Fig. 10
Fig. 11
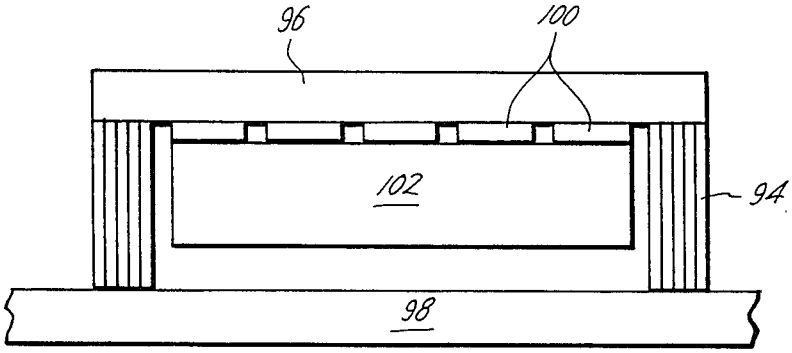

PRINTED WIRE CONNECTOR

BACKGROUND OF THE INVENTION

The present invention relates to a high density, high performance connector for interconnecting elements, and especially, elements having different wiring densities.

Recent advances in micro-circuit techniques have resulted in significantly smaller, high density electronic components. Oftentimes, it is desirable to interconnect these high density components or to interconnect one high density component to a less dense, more course lithography. Due to the differences in densities, it is necessary for the connector to be mateable to both densities, i.e., to provide for space transformation. Such connectors need to offer high density and high performance, preferably at low cost.

SUMMARY OF THE INVENTION

It is therefore an object of the present invention to provide a high density, high performance connector.

Another object of the invention is to provide a high density connector which can interconnect components of different wiring densities.

A particular object of the invention is to provide a high density connector which can interconnect low cost, high volume components, such as printed circuit boards, and high precision components, such as high density multi-chip substrates.

A further object is to provide a high density connector of the type above which can connect components positioned at any angle from one another.

A still further object of the invention is to provide a connector which is removable.

An additional object of the invention is to provide a high density connector having known and well-controlled impedance.

Still another object of the invention is to provide a connector in which the impedance can be modified for different technological requirements.

Also, an object of the invention is to provide a connector having means for distributing large amounts of power in a fashion similar to a signal interconnector.

Thus, in accordance with one aspect of the present invention, there is provided a printed wire connector for connecting circuit elements, comprising at least one module which includes an insulative layer and electrically conductive wires extending across one face of the insulative layer to connect elements at opposite ends of the wires. Preferably, the printed wire connector includes a series of the modules stacked one on another.

In a preferred embodiment, the printed wire connector, further includes a conductive layer, i.e., either a voltage or ground plane, positioned on the side of the insulative layer opposite the conductive wires, and a second insulative layer on the other side of the conductive layer.

Also, the printed wire connector can include a plurality of passageways extending through the series of modules and receiving means for aligning the module and for providing contact with certain of the conductive layers.

In order to account for thermal expansion of the modules, the connector also can include means for spacing the modules in relation to one another, for example, an elastic member positioned between select modules.

In accordance with another aspect of the invention, there is provided a method for connecting circuit elements, comprising the steps of positioning two circuit elements to be interconnected in desired relation to one another, and contacting exposed ends of conductive wiring with attach points on each of said circuit elements.

The present connector advantageously utilizes high volume, low cost parts to provide a high density interconnect. The connector, on the one hand, accommodates relatively coarse, printed circuit board lithography that is produced by many vendors, while, on the other hand, also accommodates high density substrates. The design can accommodate a variety of wiring densities by varying module and conductor thicknesses. Because the design is modular in nature, a variety of sizes is offered. The shape of the connector is also highly variable to connect between elements positioned at any angle relative to one another. The connector is suitable for very wide bandwidth since the impedance is known and well controlled. Finally, the connector is suitable for use with a wide variety of materials, including advantageous insulative and conductive materials.

Further objects, features and advantages of the present invention will be apparent from a review of the detailed description of preferred embodiments which follows, when considered together with the figures of drawing, a brief description of which follows.

BRIEF DESCRIPTION OF THE DRAWING

In the drawing:

FIG. 8 is a cross-sectional view of a bolt construction according to the present invention.

FIG. 9 is a partial cross-sectional view of an aligning jig according to the present invention.

FIG. 10 is an isometric view of a module of a printed wire connector according to the present invention.

FIG. 11 is an isometric view of a printed wire connector having external, surface mounted circuit components.

DETAILED DESCRIPTION OF PREFERRED EMBODIMENTS

Figure 1:
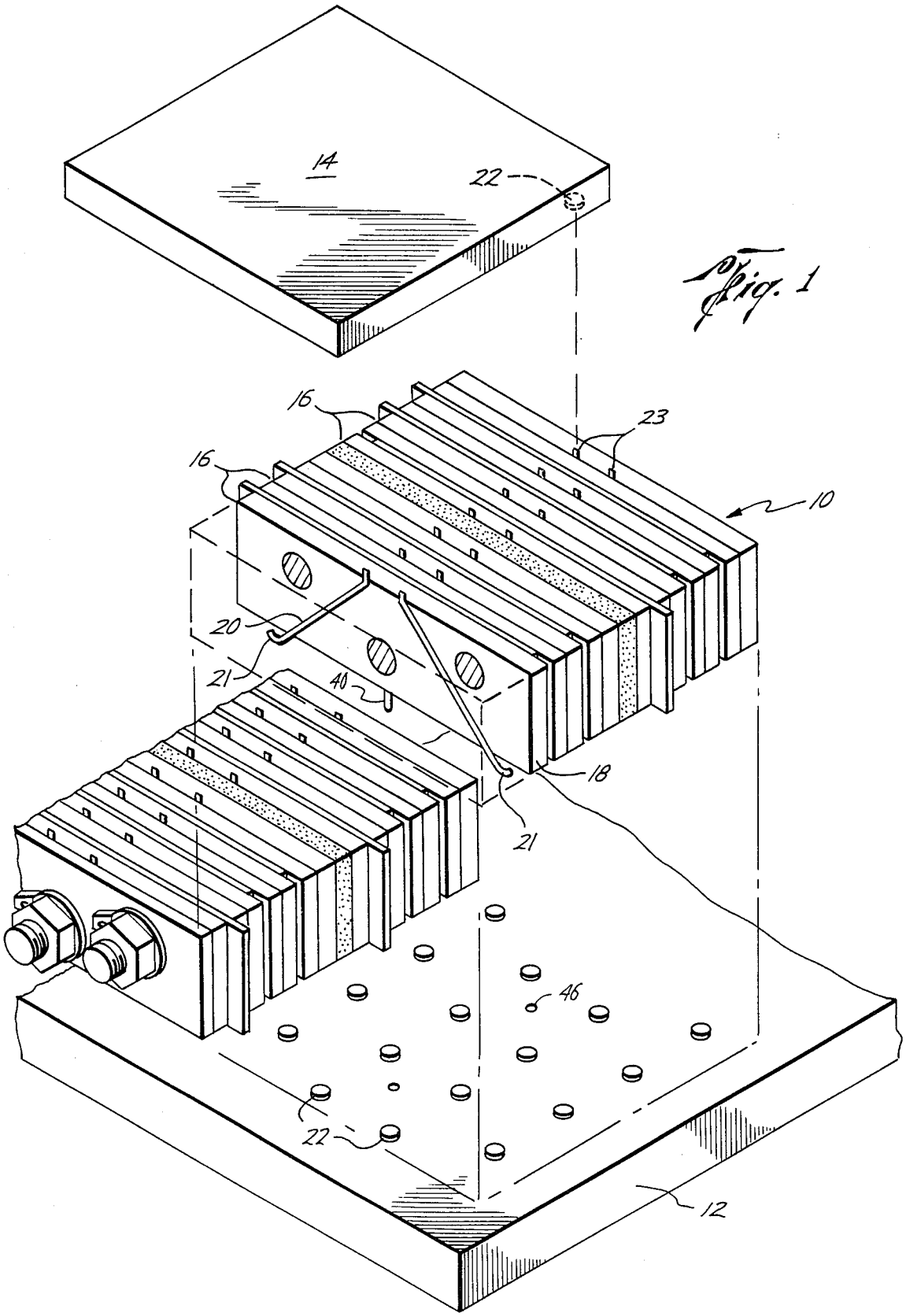
FIG. 1 is an exploded isometric view of an assembly incorporating the connector of the present invention.

The present invention is illustrated in FIG. 1. The connector 10 is positioned between a mother board 12, e.g., a lower density printed circuit (P.c.) board, and a daughter board 14, e.g , a higher density multi-chip substrate. As illustrated, the connector 10 is formed from a number of modules 16 placed adjacent one another and laminated. Each module includes at least an insulative layer 18 and electrically conductive wires 20 applied to one face of the insulative layer. The conductor ends 21 and 23 are exposed and specially designed for proper bending moment and proper contact pressure with the pad arrays 22 of the mother board and daughter board 14.

The mother and daughter boards an assume any variety of applications and/or densities. As exemplified above, the mother board 12 can be the lower density board, with the daughter board 14 being a high density substrate. For illustrative purposes, this design of the boards will be described below.

The wires 20 are positioned on the insulative layer so as to provide contact points with the lower density p.c. board and, at the same time, with the higher density substrate 14. The particular wire pattern varies with the densities of the boards and/or substrates being interconnected. In the embodiment shown on the front module of the connector 10, the wires 20 fan out at the base of the module to register with the pads of the low-density p.c. board. Of course, if the pads 22 are more dense than those illustrated in FIG. 1, the wires are etched so that the ends 21 are closer together. Further, the wires of adjacent modules can assume different geometries. For example, the wires of the next adjacent module in the connector of FIG. 1 can be positioned in such a manner that the ends are closer together to register with more dense pads. Such an embodiment is illustrated in FIGS. 2 and 3.

Figure 2:
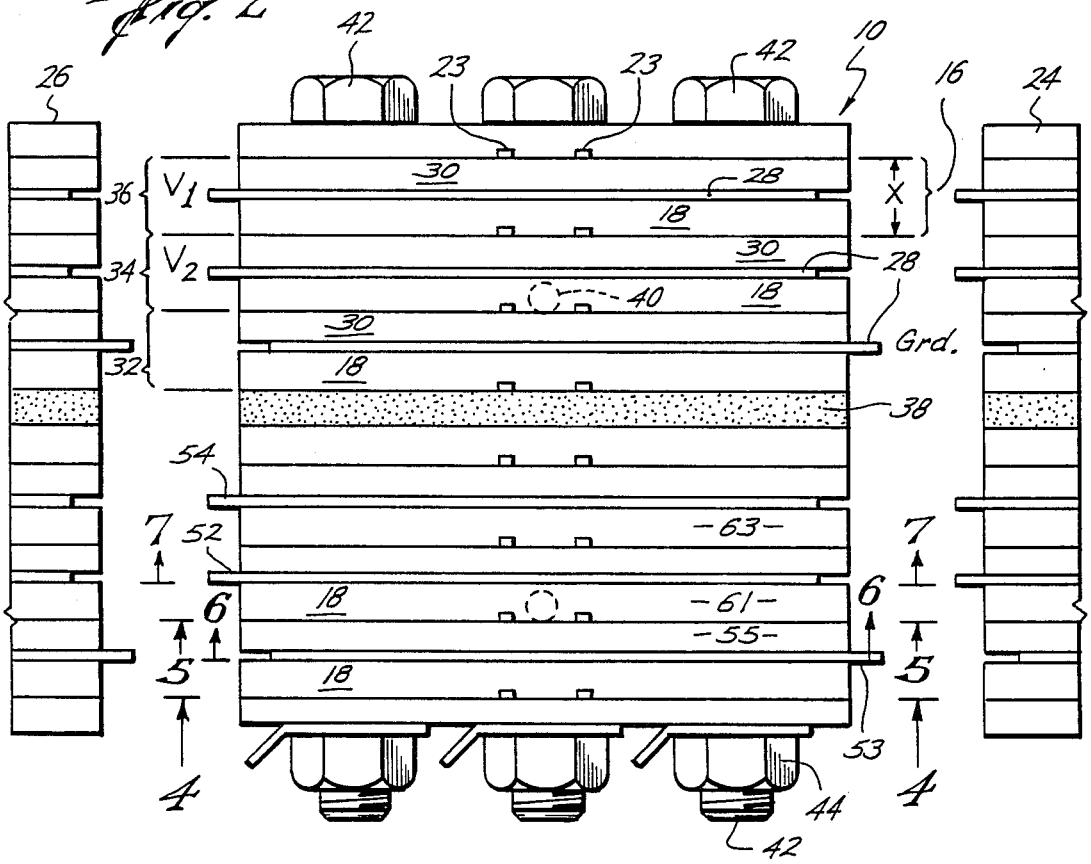
FIG. 2 is a top plan view of a connector according to the present invention.

FIG. 2 is a top view of the connector 10. Adjacent connectors 24 and 26 are shown in partial view. The ends 23 extending from the top of the connector are shown. A module 16 is shown and referenced by the dimension "x". As previously mentioned, each module includes at least the conductor wires 20 and insulative layer 18. In preferred embodiments, the modules also include a conductive plane 28. The layer 28 can be either a voltage plane or a ground plane. FIG. 2 illustrates both embodiments. The conductive plane 28 is positioned on the side of the insulative layer opposite the conductive wiring. In order to separate and insulate the conductive planes from the adjacent conductive wiring, a further insulative layer 30 is positioned therebetween. Thus, a module according to this embodiment has the following form—conductive wiring/insulative layer/voltage or ground plane/insulative layer. A unit of modules of this construction is shown in FIG. 2 as comprising modules 32, 34 and 36.

It will be apparent that the modules can be placed end-to-end rather than face-to-face as is illustrated in FIG. 2. The design choice being dependent, of course, on the application.

Figure 3:
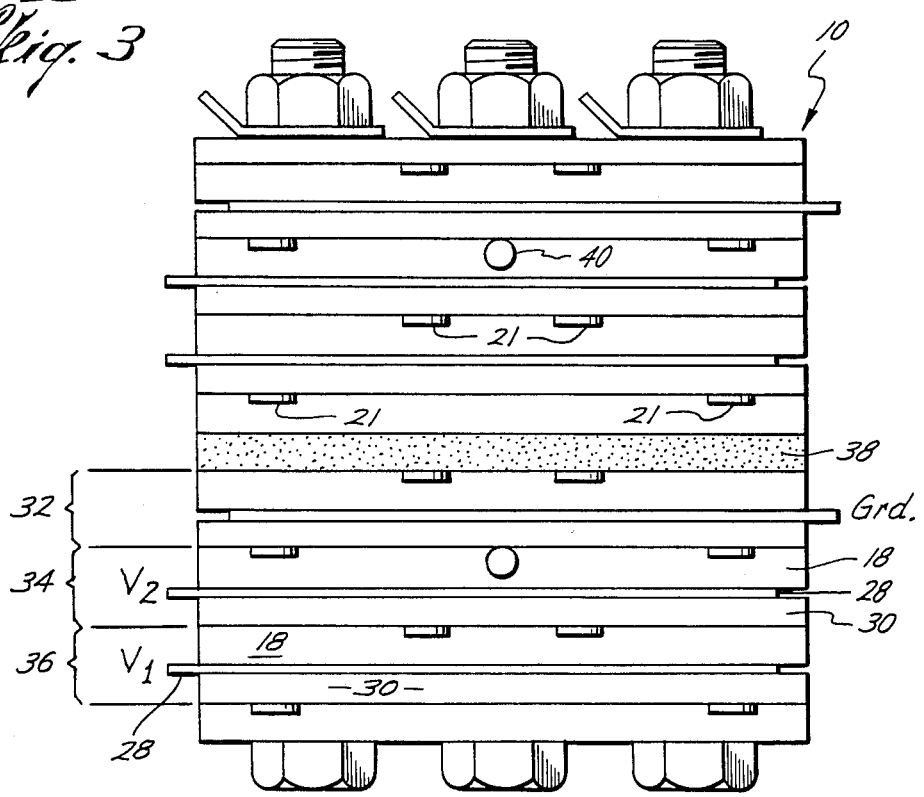
FIG. 3 is a bottom plan view of a connector according to the present invention.

FIG. 3 illustrates the identical connector construction when viewed from below. Like elements are given the same reference numbers as before. As FIG. 3 shows, the spacing of the ends 21 of the conductor wires can vary from module to module. Module 32 reflects a module having ends which are more closely spaced apart to contact with more dense attach pads. In comparison, the wire ends of the module 34 are spaced farther apart to register with less dense attach pads. Module 36 has a wire geometry like that of module 32. FIGS. 2 and 3 reflect only one of many embodiments of connector wiring architecture which depends simply on the densities of the boards to be interconnected.

For example, for connection to a high density substrate, the conductor ends 23 may be separated by 0.010", whereas the spacing of the conductors on the low density end 21 may be 0.050" on one module and 0.150" on the next adjacent module. Such a spacing Provides 200 interconnects per inch with a pad spacing of 0.010" on one side and 0.20" by 0.050" spacing on the other side.

Registration of the wire ends of the connector to the attach pads of the substrate and board, of course, is a critical consideration of the connector construction. The consideration is amplified as the number of modules in a connector increases due to tolerance and expansion factors. As a solution to this concern, the connector can include a flexible spacing connector 38 positioned between select modules. The connector 38 can be made from an elastomeric or metal material. For example, a rectangular elastomeric cushion or a metal spring can be used.

Additionally, the connector 10 can be provided with locating pins 40. The pins 40 extend into a slot formed in the board or substrate and, especially when combined with the flexible connector 38, serve to remedy tolerance and expansion variances between the boards/substrates and connector and, thus, achieve better contact between conductor ends 21 and pad arrays 22.

Finally, the connector 10 can include bolts 42 which pass longitudinally through the connectors. Nuts 44 are provided to be screwed onto the bolts to secure the modules. The bolts and passages therefor will be discussed in more detail below in relation to FIGS. 6–9.

Instead of bolts, the layers of the connector can be joined by a variety of techniques known to the skilled artisan including gluing, firing ceramics, etc. The connector, of course, can be made as a multi-layer printed circuit board with filled vias serving the purposes of the bolts.

In a high density connector of the present design, it is important to achieve good signal fidelity through controlled impedance. The present design achieves this result by offering variability of thickness and width of the "insulative layer". By using any one of a plurality of materials for the insulating layer, a particular dielectric constant can be selected and high frequency performance can be achieved. Therefore, by varying the thickness and width of this material of a known dielectric constant, a specific characteristic impedance can be achieved within a range of tolerances. By matching the particular characteristics impedance to the geometry and electrical characteristics of the host environment, the connector serves to prevent cross-talk, distortion, and ringing between the various layers. Thus, the fidelity of signals passing through the connector can be preserved by an appropriate selection of dielectric and geometric configuration.

Figure 4:
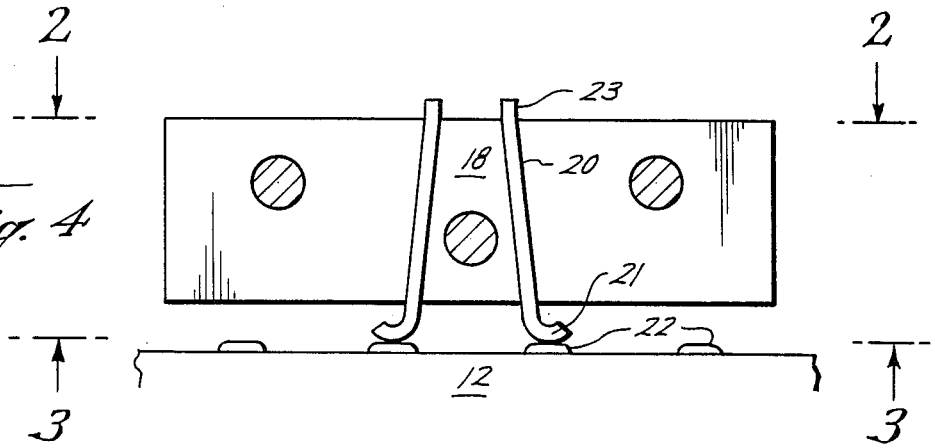
FIG. 4–7 are cross-sectional views of the connector of FIG. 2.
Figure 5:
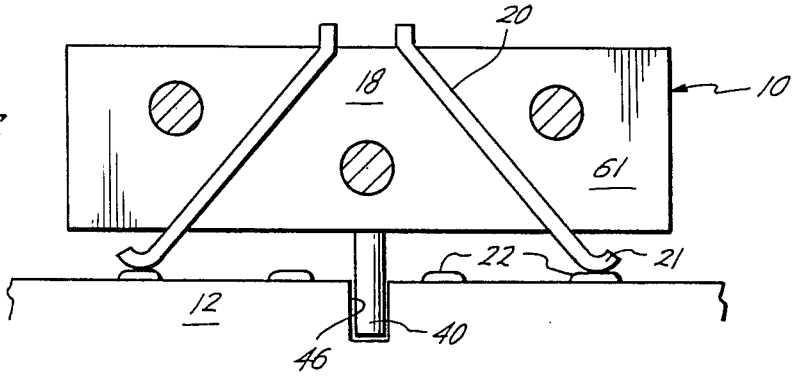

As previously discussed, the ends 21 and 23 are specially designed to provide proper bending moment and pressure contact with the attach pads. FIGS. 4 and 5 illustrate such a design for contacting the ends 21 with the attach pads 22 of the p.c. board 12. Also, a comparison of the conductive wiring of FIGS. 4 and 5 reveals the different wiring construction previously discussed, with FIG. 4 illustrating contact to attach pads 22 which are closer together than those of FIG. 5. Obviously, the wiring 20 can be placed on the insulating layer 18 at any variety of angles, shapes or directions.

While the figures illustrate each conductive wire as a unitary structure, it is also possible to design the wiring such that the ends 21 and 23 can be applied after the layers are joined. This offers an advantageous assembly procedure whereby the wires are patterned onto the insulative layers which are joined or laminated together. Thereafter, the ends can be attached.

FIG. 5 also illustrates the locating pin/slot arrangement previously discussed and shown by FIGS. 2 and 3. As FIG. 5 shows, the locating pin 40 extends from the connector 10 vertically into a receiving slot 46 of the p.c. board 12. Similarly, another pin can extend from the top of the connector and into a slot formed in the substrate 14 (not shown in FIG. 5).

Figure 6:
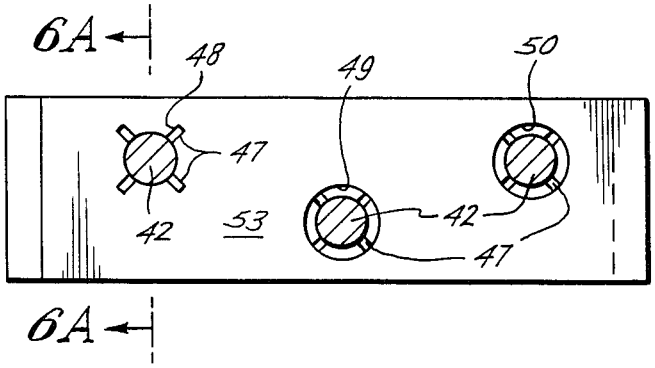
Figure 6A:
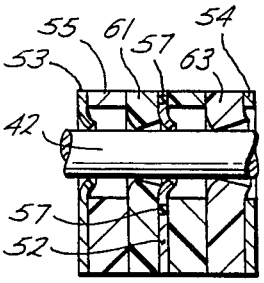
FIG. 6A is a cross-sectional view of the bolt and passageway construction of FIG. 6.
Figure 7:
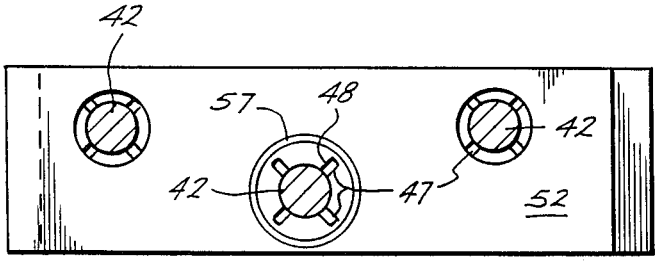

The provision of bolts and passages for these bolts, mentioned above, is illustrated in more detail by the cross-sectional views of FIGS. 6–8. FIG. 6 depicts the provision of three passageways 48, 49 and 50 which extend through the modules. The passageways can assume any variety of configurations depending primarily on whether the bolt passing therethrough is to contact the conductive plane housing the passageways. FIGS. 6, 6A and 7 illustrate three alternatives.

FIG. 6 depicts the passageways formed in a voltage plane 53. Passageway 48 is formed simply by making cross-cuts 47 in the voltage planes. The bolt 42 then is pressed through the orifice. As a result, at least four points of contact are developed between the bolt and the voltage plane providing a method of self-centering for the bolts. This provides a level of redundancy, as well as a means for providing multiple voltages through the bolts.

In those cases in which contact between the conducting plane and bolt is not desired, the passageway can be etched or bored to a circumference larger than that of the bolt. Such a construction is shown in Passageways 49 and 50. Cross-cuts 47 in the underlying insulative layers are shown at passageways 49 and 50.

As an alternative to boring the conducting plane, the conducting plane is cross-cut as in the embodiment above for providing electrical contact. However, the conducting plane is further modified by the provision of a moat or ring 57 formed radically outward of the cross-cut. This embodiment has the advantage that the cross-cuts in the conducting plane provide a spring-like action which assists the centering of the bolts, and the moat or ring prevents electrical flow from the bolt throughout the conducting lane. FIG. 6A illustrates all three embodiments. Plane 53 comprises cross-cuts 47 which provides contact between the bolt 42 and plane 53. Insulative layer 55 is designed so that it does not abut the bolt 42. This gives the leaves of the conductive plane 53 formed at the cross-cuts room to bend back as shown. Plane 52 has also been cross-cut at the point of bolt passage. In this embodiment, the plane comprises a ring shown in cross-section 57. Finally, plane 54 has been bored away around the bolt. Insulative layers 61 and 63 are cross-cut and are shown sweeping back slightly as a result of the passage of the bolt there through.

FIG. 7 illustrates a similar embodiment to FIG. 6 for the ground plane 52. In this instance, the center bolt 42 contacts the ground plane, while the bolts 42 on either side pass through without contacting a conductor.

The bolts, in addition to keying the conducting planes of the connector into external Power sources and ground planes and to connecting the modules of the connector, assure long range precision of module spacing. FIG. 8 illustrates this function. As shown, the threads of the bolt 42 engage the conducting planes 28, thus setting Proper spacing of the module. Such a fixturing mechanism is important in assuring alignment of the conductive wiring of the connector and the attach pads of the boards and substrates. Such a function is especially important where many modules are stacked due to the cumulative effect of width variation due to tolerance levels in manufacture of the insulative layer. This effect will be referred to hereafter as "periodicity".

The bolts 42 are only one embodiment of such guides; as another example, an external corrugated box or jig can provide the same function. FIG. 9, in partial cross-section, shows an example of such a corrugated jig 64. The jig 64 registers with the extending conductive planes 28 in the same manner as the bolt of FIG. 8.

FIG. 10 is an isometric view of one module of the present connector. Obviously, if minimal connections are required, the connector can comprise only one such module. As the complexity of the lithography increases, however, the number of modules for the requisite connector also increases. An advantage of the present connector architecture is the fact that it is modular and, as such, can comprise a large number of individual modules and thus conductive wiring. The problems of expansion, contraction and Periodicity are accounted for by the joint combination of flexible connectors 38 (see FIG. 2) and registering means, such as the bolts or external jigs.

The module 66 of FIG. 10 consists of a number of conductive wires 20 extending along the face of insulative layer 18. Immediately adjacent insulative layer 18 is a conductive Plane 28. Completing the module 66, a further insulative layer 30 is placed on the other side of the conductive plane 28 to insulate same from the conductive wiring 28.

Figure 12:
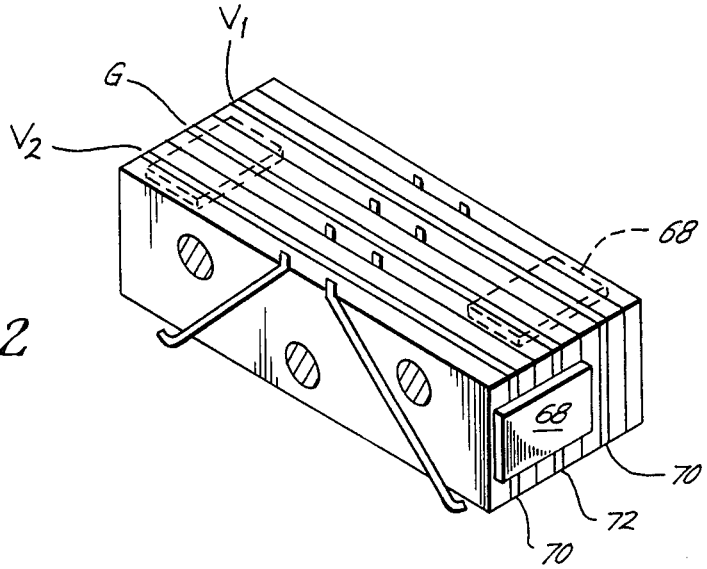
FIGS. 12–13 are isometric views of a module of a printed wire connector having internal mounted circuit components.
Figure 13:
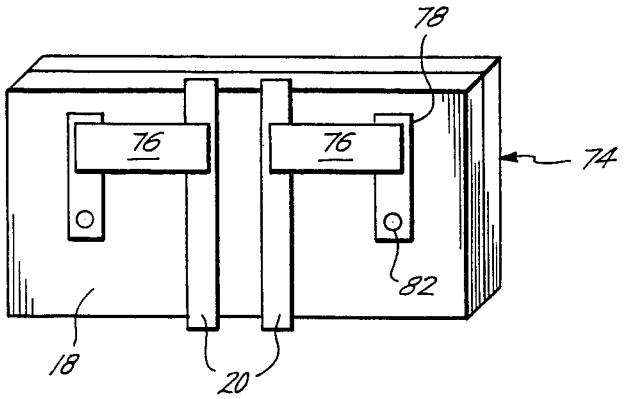

The present connector construction also provides for modifications to the conductive wiring, either internally on individual modules or externally on the assembled connector. FIGS. 11–13 illustrate some embodiments of such construction.

According to FIG. 11, the wiring modifications are done once the connector is assembled. As shown, decoupling capacitors 68 are mounted on the surface of the connector. The voltage planes 70 and 72, for possible attachment to the capacitors 68, are also shown. FIGS. 12 and 13 illustrate the provision of additional components to individual modules. According to FIG. 12, termination resistors 76 are provided on the face of the insulating layer 18 and in contact with conductive wires 20. The resistors 76, at their other end, connect to a conducting pattern internal to the module, which, in turn, connects to a terminating reference voltage structure distributed through the passageways 82 in the form of a conducting bolt, a plated-through hole or a via that connects to the voltage plane 74.

Alternatively, the module 84 of FIG. 13 includes surface mounted chips 86. The chips are connected to power and or ground planes by passageways 88. Terminating resistors 90 are provided in contact with the conductive wiring 20 and are, in turn, connected to the terminating reference voltage plane (not shown) by passageways 92. Thus, many different variations in circuitry are available according to the present invention. The above embodiments are, of course, provided as examples and are not limiting.

Figure 14:
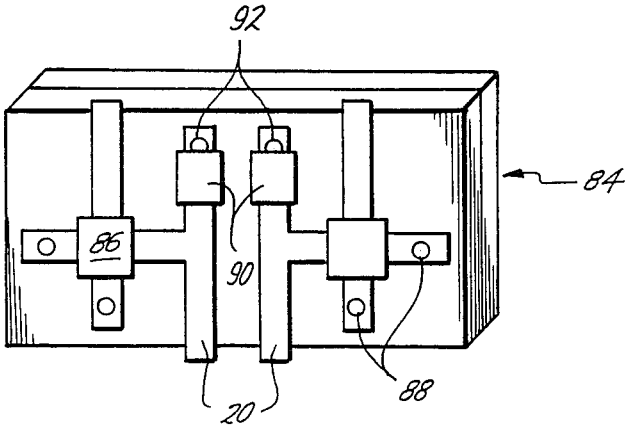
FIG. 14 is a front view of a printed wire conductor in one application according to the present invention.

The connector according to the present invention can assume a wide variety of applications and designs. FIGS. 14–18 illustrate some of these embodiments. A typical use of the connector is shown in FIG. 14. The connector 94 extends between and connects a multichip substrate 96 and a more course, less dense p.c. board 98.

The chips 100 are shown attached to the substrate. Attached to the other side of the chips is a heat sink 102.

The connectors are not limited to parallel stacked boards in which the connector extends orthogonal thereto. Instead, the connector can assume any number of shapes to connect boards positioned at any angle relative to one another. FIGS. 15–18 illustrate possible designs.

Figure 15:
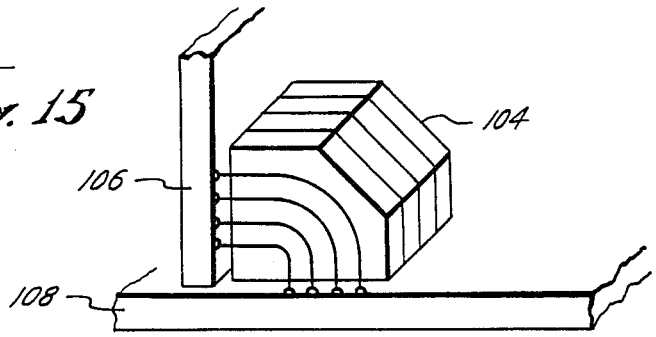
FIGS. 15–18 are isometric views of alternative designs of printed wire connectors according to the present invention.
Figure 16:
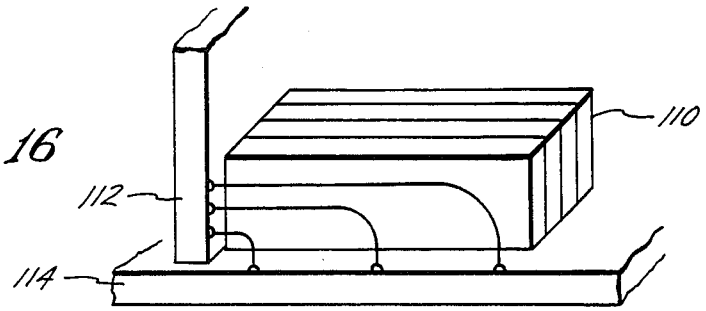
Figure 17:
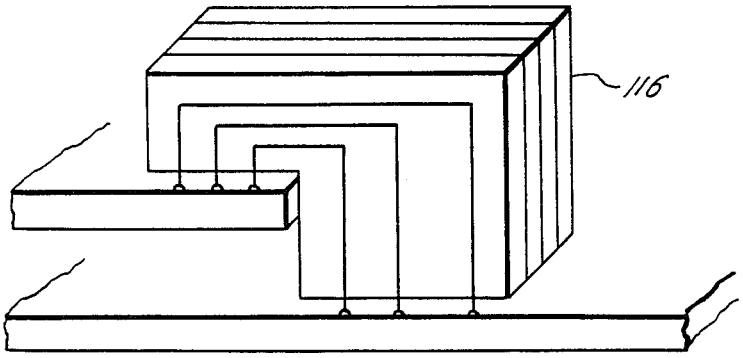
Figure 18:
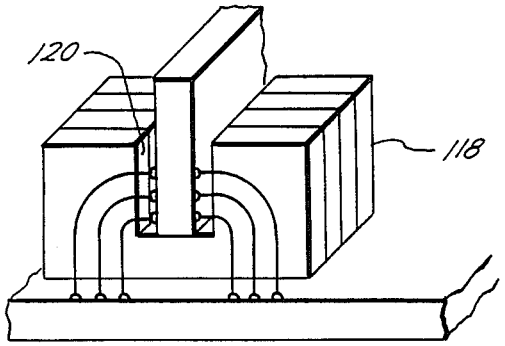

In FIG. 15, the connector 104 extends between perpendicular boards 106 and 108. The boards are schematically shown to have similar densities. Accordingly, the adjacent conductive wiring is parallel, i.e., a space transformation of 1:1. In comparison, the connector 110 of FIG. 16 extends between and connects boards of different densities, e.g., a high-density substrate 112 and a less dense p.c. board 114. FIGS. 17 and 18 show different connector designs serving the same interconnect function as above. In FIG. 17, the connector 116 connects parallel boards of different densities; in FIG. 18, the connector 118 connects orthogonal boards of similar densities, wherein the connector has a slot 120 for receiving the vertically extending board.

Obviously, other designs are possible and equally desirable. As the figures illustrate, the connector can interconnect boards at any angle to one another and having a wide varieties of wiring densities.

The connectors of the present invention utilize presently available materials. The conductive wiring and conducting plane can be formed from a variety of metals, for example, copper, aluminum, gold, and superconductors such as niobium (Nb) and yttrium barium copper oxide (YBaCuO). Particularly preferred is copper. Likewise, any of a variety of insulative materials can be used. For example, a number of polymers provide acceptable insulative properties, including polyimide, FR4, FR5, etc. Additionally, ceramics such as alumina can also be used as insulation.

The present connector advantageously utilizes high volume, low cost parts to provide a high density interconnect. The connector, on the one hand, accommodates relatively coarse, printed circuit board lithography that is produced by many vendors, while, on the other hand, also accommodates high density substrates. The design can accommodate a variety of wiring densities by varying module and conductor thicknesses. Because the design is modular in nature, a variety of sizes and, thus, connectability is offered. The shape of the connector is also highly variable to connect between elements positioned at any angle relative to one another. Finally, the connector is suitable for a wide bandwidth since the impedance is known and well controlled.

The present invention, therefore, is well adapted to carry out the objects and attain the ends and advantages mentioned above, as well as others inherent therein. While presently preferred embodiments of the invention have been described for the purpose of disclosure, numerous changes in the details of construction and arrangement of parts may be made without departing from the spirit of the present invention and the scope of the appended claims.

What is claimed is:

1. A printed wire connector for connecting components, comprising a series of modules positioned adjacent each other, said modules including an insulative layer and electrically conductive wires extending across one face of said insulative layer to connect elements at opposite ends of said wires, wherein said modules further including a conductive layer positioned on the side of said insulative layer opposite said conductive wires.

2. A printed wire connector as claimed in claim 1, wherein said conductive layer is a voltage plane.

3. A printed wire connector as claimed in claim 1, wherein said conductive layer is a ground plane.

4. A printed wire connector as claimed in claim 1, wherein said series of module comprises a plurality of passageways extending longitudinally through said series of modules.

5. A printed wire connection as claimed in claim 1, further comprising means for keying the connector with the elements to be connected.

6. A printed wire connector as claimed in claim 1, further comprising means for spacing said modules in relation to one another.

7. A printed wire connector as claimed in claim 6, wherein said spacing means includes an elastic member positioned between certain of said modules.

8. A printed wire connector as claimed in claim 1, wherein the ends of said conductive wires extend past the edges of said insulative layer.

9. A printed wire connection, as claimed in claim 8, wherein said conductive wires comprises a body portion extending across the face of said insulative layer and separate end portions applied to said body portion.

10. A printed wire connector as claimed in claim 1, wherein said series of modules comprises at least one passageway extending longitudinally through said series of modules.

11. A printed wire connector as claimed in claim 10, further comprising means for aligning said modules.

12. A printed wire connector as claimed in claim 11, wherein said aligning means includes a jig external to said series of modules.

13. A printed wire connector as claimed in claim 11, wherein said aligning means includes a threaded bolt which extends through said passageway.

14. A printed wire connection as claimed in claim 13, wherein said bolt contacts certain of said conductive layers.

15. A printed wire connector for connecting elements of different wiring densities, comprising:

a series of modules, each of said modules, including:
- an insulative layer,
- electrically conductive wires extending across one face of said insulative layer, and
- a conductive layer positioned on the side of said insulative layer opposite said conductive wires;

an elastic member positioned between certain of said modules;

a plurality of passageways extending through said series of modules; and at least one threaded bolt extending through said passageways for aligning said modules and for making electrical contact with certain of said conductive layers.

16. A printed wire connector as claimed in claim 15, wherein the ends of said conductive wires extend past the edges of said insulative layer.

17. A printed wire connector as claimed in claim 15, further comprising means for keying the connector with the elements to be connected.

18. A printed wire connector as claimed in claim 15, further comprising means for spacing said modules in relation to one another.

19. A printed wire connector as claimed in claim 18, wherein said spacing means includes an elastic member positioned between certain of said modules.

* * * * *